US010638892B2

(12) United States Patent
Bois et al.

(10) Patent No.: US 10,638,892 B2
(45) Date of Patent: May 5, 2020

(54) ONE-HANDED WIPES DISPENSER

(71) Applicant: Johnson & Johnson Consumer Inc., Skillman, NJ (US)

(72) Inventors: Dimitri Bois, Paris (FR); Simon Duronsoy, Rouen (FR); Florent Laffin, Louviers (FR)

(73) Assignee: Johnson & Johnson Consumer Inc., Skillman, NJ (US)

( * ) Notice: Subject to any disclaimer, the term of this patent is extended or adjusted under 35 U.S.C. 154(b) by 0 days.

(21) Appl. No.: 15/606,021

(22) Filed: May 26, 2017

(65) Prior Publication Data

US 2018/0098674 A1 Apr. 12, 2018

(30) Foreign Application Priority Data

Oct. 7, 2016 (EP) ..... 16306328

(51) Int. Cl.

| | |
|---|---|
| ***B65D 83/08*** | (2006.01) |
| ***A47K 10/42*** | (2006.01) |
| ***B65D 75/56*** | (2006.01) |
| ***B65D 75/58*** | (2006.01) |
| *A47K 10/32* | (2006.01) |

(52) U.S. Cl.

CPC ..... *A47K 10/421* (2013.01); *A47K 10/42* (2013.01); *B65D 75/56* (2013.01); *B65D 75/5894* (2013.01); *B65D 83/0805* (2013.01); *A47K 2010/3233* (2013.01); *A47K 2010/3266* (2013.01); *A47K 2201/00* (2013.01); *B65D 2575/565* (2013.01); *B65D 2575/586* (2013.01)

(58) Field of Classification Search

USPC ..... 221/47, 33–63; 206/449, 607, 613, 621, 206/629

See application file for complete search history.

(56) References Cited

U.S. PATENT DOCUMENTS

| | | | |
|---|---|---|---|
| 4,131,195 | A | 12/1978 | Worrell, Sr. |
| 4,531,637 | A | 7/1985 | Cusmano |

(Continued)

FOREIGN PATENT DOCUMENTS

| | | | |
|---|---|---|---|
| AU | 768679 | B | 6/2001 |
| CA | 2073792 | A1 | 1/1994 |

(Continued)

OTHER PUBLICATIONS

European extended search report dated Mar. 3, 2017, for EP 16306328.2.

*Primary Examiner* — Gene O Crawford
*Assistant Examiner* — Ayodeji T Ojofeitimi
(74) *Attorney, Agent, or Firm* — Laura A. Donnelly

(57) ABSTRACT

A dispensing package and method of using a dispensing package, the dispensing package including interior region defined by a top surface, a bottom surface, a front surface, a back surface, a first side and a second side; the top surface including an aperture for access to the interior region, the top surface being releasably sealed by a top cover; the bottom surface having a coating of an adhesive area on at least a portion of the bottom surface, where the adhesive area is releasably covered by a leaflet, where the leaflet has an area at least as large as the adhesive area, and where the leaflet is secured to the bottom surface of the package at a leaflet securement area.

18 Claims, 4 Drawing Sheets

(56) References Cited

U.S. PATENT DOCUMENTS

| | | | | |
|---|---|---|---|---|
| 4,651,874 | A * | 3/1987 | Nakamura | B65B 61/184 206/205 |
| 5,048,725 | A | 9/1991 | Peterson | |
| 5,242,057 | A * | 9/1993 | Cook | A47K 10/421 206/233 |
| 5,516,000 | A | 5/1996 | Freiburger et al. | |
| 5,649,643 | A | 7/1997 | Ridgeway | |
| 5,791,465 | A | 8/1998 | Niki et al. | |
| 5,857,586 | A | 1/1999 | Scherr | |
| 5,996,797 | A | 12/1999 | Flaig | |
| 6,561,378 | B1 | 5/2003 | Roessler et al. | |
| 6,997,345 | B2 * | 2/2006 | Mitchell | A47K 10/42 221/283 |
| 7,228,968 | B1 * | 6/2007 | Burgess | B65D 75/5838 206/233 |
| 8,333,511 | B2 * | 12/2012 | Rutzinger | B65D 75/5838 383/203 |
| 2003/0136793 | A1 | 7/2003 | Chen | |
| 2006/0151346 | A1 | 7/2006 | Cho | |
| 2007/0012715 | A1 * | 1/2007 | Dubreuil | B65D 75/5894 221/33 |
| 2007/0209959 | A1 | 9/2007 | Burgess | |
| 2010/0012533 | A1 | 1/2010 | Burgess | |
| 2014/0001072 | A1 | 1/2014 | Christoffel et al. | |
| 2015/0353258 | A1 | 12/2015 | Yao et al. | |
| 2016/0257859 | A1 | 9/2016 | Graffy | |

FOREIGN PATENT DOCUMENTS

| | | | |
|---|---|---|---|
| CN | 203153600 | U | 8/2013 |
| DE | 3405435 | A1 | 8/1985 |
| DE | 198708754 | U1 | 11/1987 |
| WO | WO2001/040073 | A1 | 6/2001 |
| WO | WO2001/076436 | A1 | 10/2001 |

* cited by examiner

ONE-HANDED WIPES DISPENSER

CROSS-REFERENCE TO RELATED APPLICATIONS

The present invention claims priority to EP Patent Application No. 16306328.2, filed Oct. 7, 2016, the entire content of which is incorporated herein by reference in its entirety.

FIELD

The present invention relates to packages for dispensing products, including wipes. Specifically, the invention relates to dispensers that allow for the dispensing of products with one hand, and further providing the ability to transport the package and re-use the package in a plurality of locations.

BACKGROUND

Wipes, or moist towelettes, are an important part of personal care and hygiene for a number of people. One particular group of individuals that rely upon the use of wipes includes parents or caregivers of infants and small children. Wipes are typically used to cleanse the diaper region of infants and small children after urination or defecation in the diaper. Wipes are typically housed in an airtight and water-tight package to keep the wipes contained therein moistened with cleansing liquid. These packages typically have an opening through which the wipe can be pulled one at a time. However, in order to remove only one wipe with the hand, it is typically important to hold the package with the opposite hand to keep the package from moving.

However, when a caregiver is using a wipe to care for an infant or other small child, the caregiver typically desires to use the free hand to hold the infant steady to avoid rolling or other movement, particularly when the wipe is being used on a raised surface, such as a changing table or other surface. Further, the caregiver often wishes to transport the package to another location when not in use, or to store the wipes package out of sight. The present invention seeks to allow a user to secure a wipe dispenser to any reasonably or substantially dry and flat surface, preferably clean surface, allowing dispensing with one hand, and also allowing movement or transporting of the package when not in use.

SUMMARY

The present invention includes a dispensing package and method of using a dispensing package. In one aspect, the dispensing package may include an interior region including at least one wipe, the interior region being defined by a top surface, a bottom surface, a front surface, a back surface, a first side and a second side; the top surface including an aperture for access to the interior region, the top surface being releasably sealed by a top cover; the bottom surface having a coating of an adhesive area on at least a portion of the bottom surface, where the adhesive area is releasably covered by a leaflet, where the leaflet has an area at least as large as the adhesive area, and where the leaflet is secured to the bottom surface of the package at a leaflet securement area.

The invention may additionally include a method of using a dispensing package, which includes the steps of grasping a package with at least one hand or a grasping tool, the package including: i. an interior region including at least one wipe, the interior region being defined by a top surface, a bottom surface, a front surface, a back surface, a first side and a second side; ii. the top surface including an aperture for access to the interior region, the top surface being releasably sealed by a top cover; and iii. the bottom surface having a coating of an adhesive area on at least a portion of the bottom surface, where the adhesive area is releasably covered by a leaflet, where the leaflet has an area at least as large as the adhesive area, and where the leaflet is secured to the bottom surface of the package at a leaflet securement area; separating at least a portion of the leaflet from the adhesive area; and attaching the adhesive area to a surface.

A method may further include the step of separating at least a portion of the top cover from the top surface, thereby opening the aperture and allowing access to the interior region. A method may further include the step of removing a wipe from the interior region of the package. A method may further include the steps of securing the top cover to the top surface, thereby sealing the aperture; unsticking the adhesive area from the surface; and placing the leaflet on the adhesive area, thereby covering the adhesive area with the leaflet.

The invention includes the use and reuse of a package, whereby a user may remove at least a portion of the leaflet, thereby exposing the adhesive area, secure the adhesive area to a surface, open the aperture by separating at least a portion of the top cover from the top surface, remove one or more wipes therein, close the top cover, unstick the package from the surface, and cover the adhesive area with the leaflet, and then repeat the steps at least one additional time.

DETAILED DESCRIPTION

Figure 1:
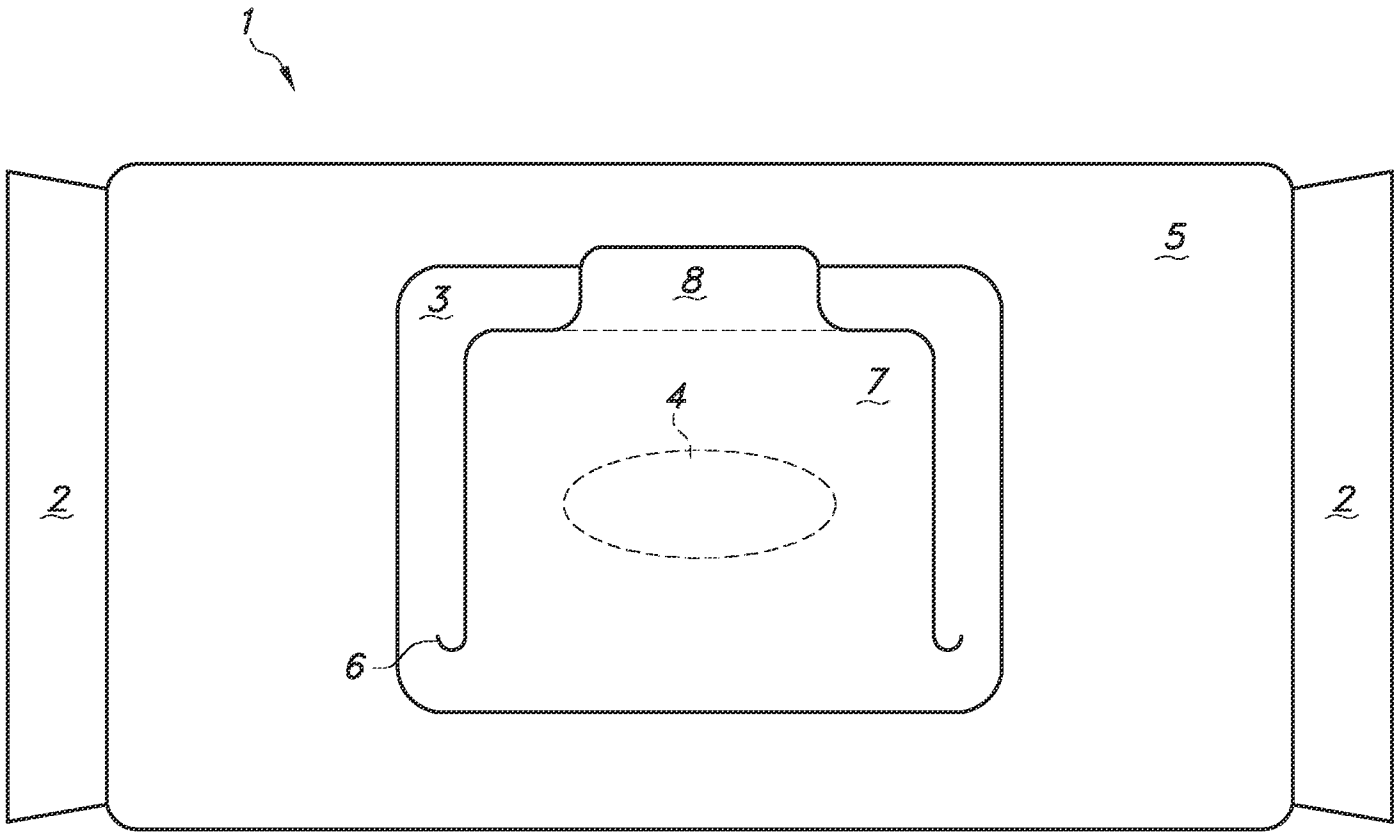
FIG. 1 is a top plan view of a package of the present invention.

A package is provided that is sized and shaped to house a plurality of wipes. As used herein, the term "wipes" includes a sheet of material, including woven or nonwoven fabrics, which are appropriately sized to be held in a hand and used to cleanse a surface, such as the skin of a human. The wipes are typically wetted with a liquid, including cleansing or moisturizing liquid. It is therefore important that the package remain in a substantially water-tight or even air-tight state when not in use. The package may contain from 5 to 500 wipes, which are typically stacked or arranged such that one wipe is at least partially on top of another wipe. The wipe is substantially flat and thin (approximately in the range of 0.1 to 2 mm thick), and may be arranged in a stacked or overlapping configuration within the package.

The wipes package may include a single, closeable and openable hole or aperture, such as on the top surface of the package, as will be described in greater detail below. In use, it is desirable to open the closeable opening, which allows access to a top surface of a wipe, enabling the user to partially insert at least one finger or tool into the package, gripping the top surface of the wipe and withdrawing the wipe from the package without withdrawing other wipes concurrently. The wipe may then be used in any desired manner, such as by wiping the skin of oneself or another person. If desired, additional wipes may be withdrawn.

When the user is finished with the wipe or wipes, the closeable opening may be closed, thereby maintaining the wipes contained therein.

It is particularly desirable that the package be transportable, so that it may be used in multiple locations. For example, it may be desired that the wipes package be placed in a diaper bag or carried by a caregiver, where it may be used in any location that cleansing is required. The package should therefore be capable of being sealed between uses sufficiently such that the wipes do not fall out of the package or lose their moistness between uses.

The present invention seeks to solve a problem that exists with currently existing wipes dispensers. The problem is that, while the user is using a first hand to grasp and withdraw a wipe, in order to keep the package steady and allow the wipe to be removed, the user's second hand holds the package in place. If the user does not hold the package with the second hand, there is a risk that the package moves as the wipe is being pulled, and therefore the wipe may not be fully removed from the package, or the package is susceptible to falling or other wipes being inadvertently removed or falling from the package.

The need to use a second hand to secure the package is undesirable, particularly when the wipe is to be used on an infant or small child, since the user typically wishes to use this second hand to secure the infant or small child in place. In instances where the child is being cleansed on a raised surface, such as a changing table or other elevated surface, holding the child secure is important to avoid the child moving and falling off of the elevated surface. Even when a child is being cleansed on the floor or ground, it is desired to keep the child from rolling or moving until the child is cleansed. This is particularly true when the cleansing is required after the child is having his or her diaper changed, and the wipe is used to cleanse feces from the child's diaper region. If the child moves during the diaper change, there is a risk that the child's sensitive diaper region will contact the floor or other surface, or that the feces may contact the floor.

The present invention provides a solution to this problem, while avoiding problems associated with previous solutions. The present invention allows a user to adequately secure the package to any surface, allowing the user to have access to the closeable opening, and where the package is secured with sufficient strength to keep the package secured during removal of a wipe with one hand. The package of the present invention may be secured to any surface, including furniture, tile, wall, floor, carpet, or other surfaces, and allows the package to be secured in any position, including with the bottom side (defined below) in a horizontal or vertical position. It is desirable that the surface to which the package is to be adhered be substantially dry and substantially flat, with the understanding that the surface may be uneven or may include grout or other tile-separating features. The surface is also desirably substantially clean, but it is not required to clean the surface to remove all dust and particles prior to adhering the package thereto. Even further, the present invention allows the package to be removed from the secured location after use, and transported by the user without risk of the package being inadvertently secured to other surfaces or in a user's bag.

Prior attempts to solve this problem have used devices such as suction cups on the bottom of the package, which are undesirable since suction cups require a particular type of surface to secure the package to. Other attempts have used a Velcro-type of system to secure the package, which again require a particular type of surface. Further, these previous solutions do not allow for placement of the package in various spaces and on surfaces, which are often required since space may be at a premium. Other attempts have used double-sided tape to secure the package, but this requires proper placement by the user and may not properly allow for repeat sticking and removal, in some instances due to dirt, dust, or other debris becoming stuck onto the adhesive surface while it is unstuck without a cover thereon. Other previous attempts have provided a sticker on the package that does not include a resealable portion, and therefore this prior attempt does not allow the user to remove the stuck package from a surface and transport it without risk of inadvertent sticking during transport. It is a benefit of the present invention to allow for one-handed use of a dispenser package, while allowing for removal, transport, and subsequent re-adhering of the package to a second surface.

With reference to the Figures, the present invention will now be described in greater detail. FIG. 1 shows a top view of an exemplary wipes package and dispenser. The dispenser 1 appears generally rectangular in shape, but it understood that the package may have any shape or configuration, including circular, square, oval, diamond and the like. The dispenser 1 includes a generally flat top surface 5, which may be rigid or may be flexible. The top surface 5 may be made from a flexible plastic material, which is substantially water impenetrable. The top surface 5 defines an area set forth by a length and width, the area being large enough to house at least one wipe within the dispenser 1. The exterior dispenser 1 may be dimensioned to be slightly larger than the interior wipes, or slightly larger than the interior wipes where the wipes are folded at least one time. In some aspects, the length of the dispenser 1 may be from about 130 mm to about 240 mm or about 160 mm to about 200 mm, and the width of the dispenser 1 may be from about 60 mm to about 180 mm, and the height or thickness of the dispenser 1 may be from about 10 mm to about 100 mm. The height or thickness of the leaflet, described below, may be from about 0.01 mm to about 1 mm.

In the Figures, first end and second end of the wipes dispenser 1 are set forth by welded sections 2, the welded sections 2 spanning the width of the top surface 5 of the dispenser 1. Welding these sections 2 is desirable to maintain the water impenetrable nature of the dispenser 1 and allows for manufacturing of the dispenser 1 when a flexible plastic material is used to form the dispenser 1. The welded area 2 may be formed by any known and conventional welding methods, including thermal welding, ultrasonic welding, or laser welding. Thus, top surface 5 may be made from a first material, including a flexible plastic material. The material from which top surface 5 is made should be capable of being printed thereon, to allow for color, words, indicia, graphics and the like.

The top surface 5 includes a means for removal of at least one wipe from the interior of the dispenser 1. In some aspects, the top surface 5 includes a central dispensing opening or aperture 4 allowing for a finger or tool to be inserted and a wipe to be removed. The aperture 4 may be any size or shape desired, but should be large enough to allow for one wipe to be removed therefrom. It is also desired that the aperture 4 be maintained sufficiently small such that the aperture 4 may be adequately covered to protect the interior of the dispenser 1. In some embodiments, the aperture 4 may be a shape of a circle, an oval, a square, a star, or other shape, and may be from about 25 mm to about 100 mm in length, or about 25 mm to about 50 mm in length (or cross-section as measured from one edge to an opposing edge) and from about 10 mm to about 50 mm, or about 15 mm to about 25 mm in width (or cross-section as measured from a second edge to opposing edge, where the second edge is offset by 90 degrees from the first edge). The ratio between the length and the width may be from about 10/1 to 1/1. For the Examples tested and described below, the ratio of the length to the width was approximately 2/1.

The aperture 4 is desirably closed when the package 1 is not being used, and the closure is desirably strong enough to ensure closure of the aperture 4 during transportation and movement of the dispenser 1. The closure should also maintain a water-tight seal when closed. The closure may be a sealable label system that is secured to the top surface 5 of the dispenser 1, and which covers the entire aperture 4 when in a closed position. The closure system may include a main closure 7, which may be substantially flat and have an area greater than the area of the aperture 4. The closure may be made of rigid material or it may be made of a flexible polymeric or plastic material. The closure 7 may be formed by pre-cutting a region larger than or equal to the size of the aperture, which allows a user to separate an opening closure portion. The closure 7 has a top surface and a bottom surface, with the bottom surface being in contact with the top surface 5 of the dispenser surrounding the aperture 4, when the closure 7 is in the closed position. The area of contact between the bottom surface of the closure 7 and the top surface 5 of the dispenser 1 may include a reuseable adhesive material, to allow the closure 7 to contact the top surface 5 of the dispenser 1 and form a secure, water-tight seal about the periphery of the entire aperture 4.

The closure system may include an area where the closure system is secured to the top surface 5 of the dispenser 1 in a secure, non-removable fashion. In the embodiment of FIG. 1, there is a secure area 3 where the closure system is secured to the top surface 5. The secure area 3 may be adhered to the top surface 5 by an adhesive, or it may be subjected to other adhesion methods, such as welding. The secure area 3 may extend fully around the aperture 4, or may only be on one, two, or three sides of the aperture 4. The secure area 3 is desirably attached to the closure 7 at a connection site 6, or multiple connection sites. In the embodiment seen in FIG. 1, the closure 7 is a substantially flat piece (sized to be larger than and fully encompass the aperture 4), which is secured to the secure area 3 at two connection sites 6. Secure area 3 may extend around the entire periphery of the closure system.

The closure system may include a tab 8, which is a non-sticky portion or other region of the closure 7 that is not secured to the top surface 5 or to the secure area 3, which allows a user to grip and pull the closure 7. The tab may be flush with the surface of closure 7 or it may extend out, as seen in FIG. 1. In use, the user grabs a portion of the closure 7, such as the tab 8, and pulls the closure 7 away from the top surface 5, where it is removed from the aperture 4. The force enacted by a user in pulling the tab 8 and pulling the closure 7 may serve to break apart a pre-cut region, thereby opening the package and allowing access to the aperture 4. Since the closure 7 (particularly the area of the closure 7 on the outside of the pre-cut area) is attached to the secure area 3, the closure 7 remains secured to the dispenser 1, but access to the interior of the dispenser 1 is achieved through the aperture 4. One or more wipes may be removed by pulling the wipe(s) through the aperture 4. When removal is complete, the closure 7 may be replaced by pressing the closure 7 back over the aperture 4, where the presence of the reusable adhesive material keeps the closure 7 in place and secured around the periphery of the aperture 4. Instead of an adhesive material, the closure 7 may be secured via a snap fit or other opening/closing method.

The top surface of the closure 7 may have printing, graphics, pictures or other indicia thereon, which may be decorative, or may identify the contents of the dispenser 1, or may include instructions how to use the product.

Figure 2:
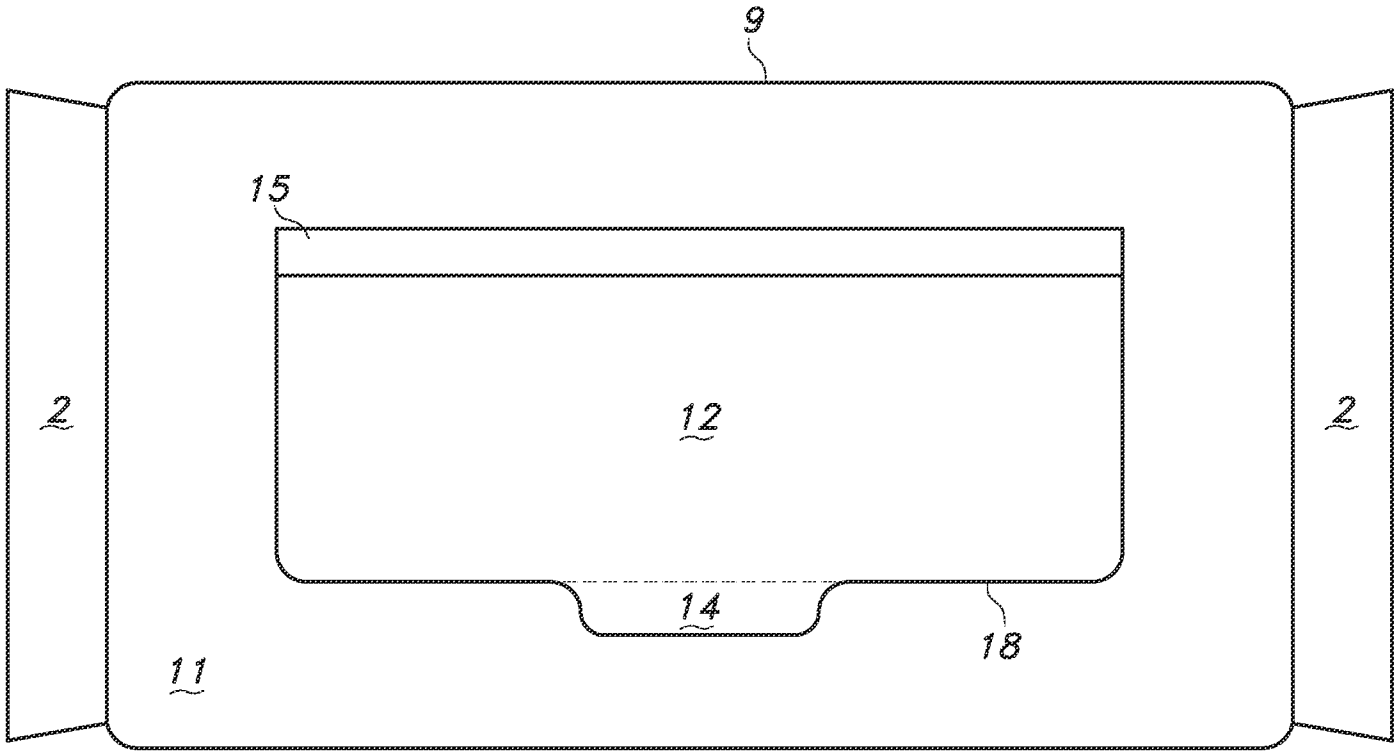
FIG. 2 is a bottom plan view of the package of FIG. 1.

FIG. 2 shows a planar view of the bottom surface 11 of the dispenser 1. Bottom surface 11 is an opposing surface from top surface 5, with the interior of the dispenser 1 therebetween. As can be seen, in FIG. 2, the welded area 2 can be seen, as the welded area 2 secures the sides of the dispenser 1 on both sides of its width. The perimeter of the surface 11 is defined by the two welded areas 2, front surface 9 and back surface 10.

Figure 3:
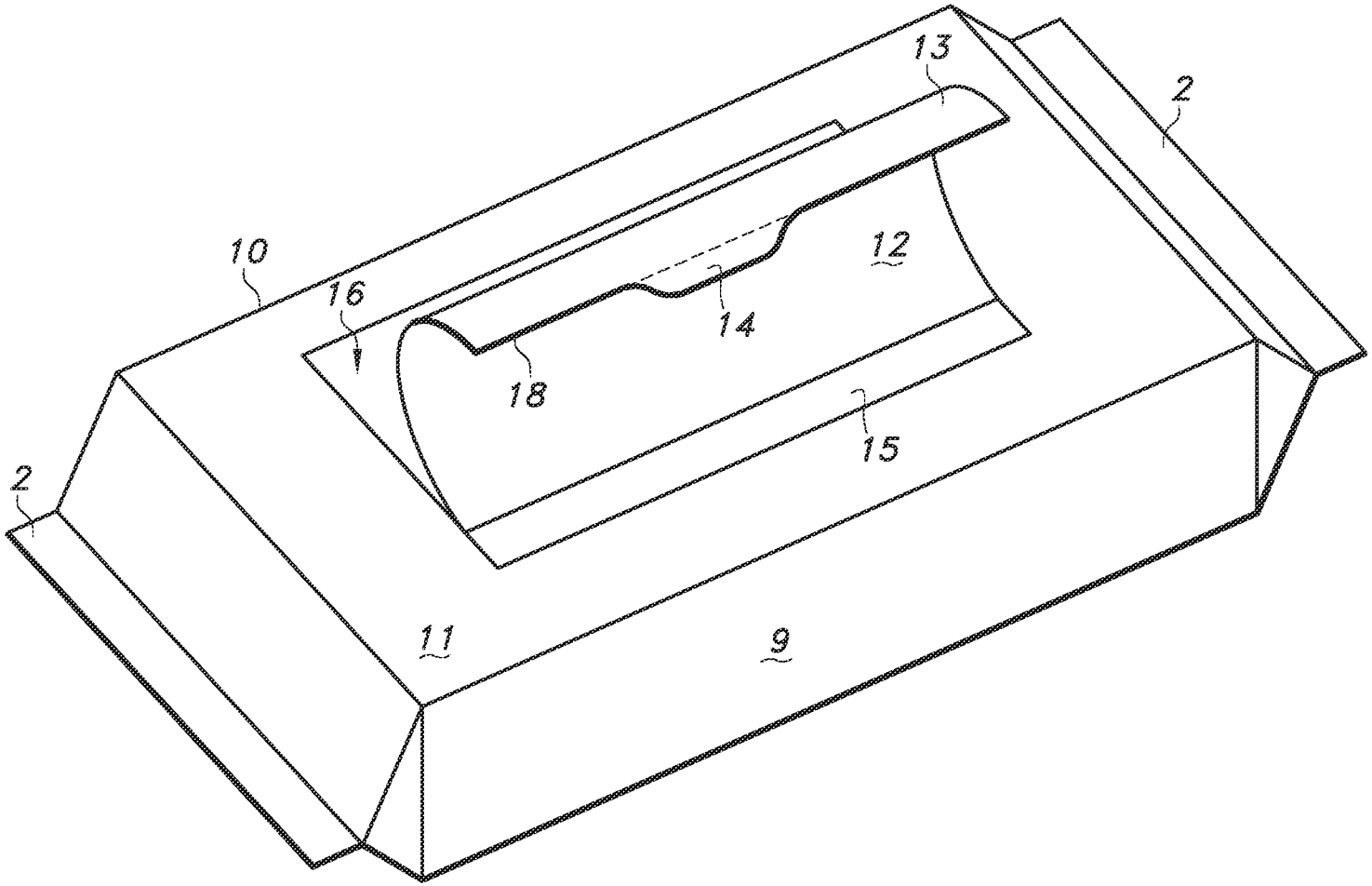
FIG. 3 is a bottom perspective view of the package of FIG. 1, as the leaflet is being opened.

On the bottom surface 11 there is a leaflet, which aids in providing the dispenser 1 with a one-handed utility. The leaflet is a generally flat, desirably flexible sheet that has an area smaller than the area of the bottom surface 11. Leaflet substantially covers an adhesive area 16 when the package is not in use, described below. The leaflet has a non-adhered surface 12, and opposed anti-adhesive coated surface 13 (or "adhered" surface), which is seen in FIG. 3. The anti-adhesive coated surface 13, which is coated with a coating of silicone polymer or other non-stick coating materials, exhibits excellent anti-adhesion and non-sticking characteristics and handling properties.

When the device is in a closed configuration, the anti-adhesive coated surface 13 is unseen, since it is abutted against an adhesive area, such that the non-adhered surface 12 is visible to a user. The non-adhered surface 12 may have printing or other indicia thereon, and may be coated with a glossy or other finish to provide a desired surface feel. The non-adhered surface 12 and/or the leaflet itself may include child-friendly features, including pictures, games, bells, or other features that a child may play with or use during the use of the dispenser. The leaflet may be of any configuration, and in certain embodiments as shown in the figures provided, leaflet has a generally rectangular configuration (seen by non-adhered surface 12), but it will be understood that any configuration may be used as desired, including circular, oval, star-shaped, square, or non-geometric shapes. Leaflet may have a first edge defining a leaflet connection area 15, described below, and an opposed second edge, a leaflet free edge 18. Leaflet free edge 18 appears substantially linear, however, it may have any shape or configuration desired.

Leaflet may include a tab 14 or other gripping feature secured at or along the leaflet free edge 18, to allow a user to quickly and easily grasp the leaflet and pull the leaflet away from the bottom surface 11 of dispenser. Since tab 14 (and leaflet free edge 18) opposes the leaflet connection area 15, the leaflet may be opened by pulling the tab 14. The tab 14 may be of any size or shape desired, and desirably is at least large enough to allow gripping by a user's fingers, such as thumb and forefinger. On the opposed side of the leaflet free edge 18 (including the tab 14), there is a leaflet connection area 15, which secures the leaflet to the bottom surface 11 of the dispenser 1. Leaflet connection area 15 should be strong enough to secure leaflet to the dispenser 1 repeatedly and withstand the force impacted when a user pulls the leaflet away from the bottom surface 11. Leaflet connection area 15 may be a welded area, or may include an adhesive material, where the adhering strength of an adhesive material in leaflet connection area 15 is stronger than that of the adhesive used to secure the anti-adhesive coated surface 13 of the leaflet. Securing anti-adhesive coated surface 13 to the bottom surface 11 is described in greater detail below.

In some embodiments, the leaflet connection area 15 includes the same adhesive material(s) that is used in the adhesive area 16, but the leaflet does not include an anti-adhesive material coating at the leaflet connection area 15. Without the use of an anti-adhesive coating, the leaflet will remain adhered to the bottom surface 11 of the package 1 in the absence of a greater level of force. In this embodiment, the adhesive materials for the leaflet connection area 15 may be the same as the adhesive used for area 16, which may include any known synthetic, semi-synthetic or natural adhesive. Adhesives used in this present invention are typically pressure sensitive adhesives, with hot melt pressure-sensitive adhesives being preferred. Pressure sensitive adhesives are normally tacky at room temperature and can be adhered to a variety of surfaces by application of light finger pressure. The pressure sensitive adhesives can include without limitation, elastomeric block copolymers, natural rubber, butyl rubber and polyisobutylene, acrylic polymers, styrene-butadiene rubber (SBR), polyisoprene, polyalphaolefins, and polyacrylates. Examples of useful thermoplastic elastomeric block copolymers include styrene-isoprene (SI), styrene-isoprene-styrene (SIS), styrene-butadiene-styrene (SBS), ethylene-propylene-diene, styrene-ethylene/butylene-styrene (SEBS), and styrene-ethylene/propylene-styrene (SEPS). Other useful adhesives may include, e.g., polyvinyl ethers, ethylene containing copolymers such as, e.g., ethylene vinyl acetate, ethylacrylate, and ethyl methacrylate, polyurethanes, polyamides, polyepoxides, polyvinylpyrrolidones and copolymers thereof, polyvinylalcohols and copolymers thereof, polyesters, and combinations thereof. Notably, in this configuration, the leaflet has opposed surfaces (the non-adhered surface 12 and anti-adhesive coated surface 13), but the region of the leaflet at the leaflet connection area 15 lacks an anti-adhesive coating.

In a first configuration (a non-adhering configuration), whereby the leaflet is secured to the dispenser 1 in a travel-ready or distribution-ready fashion, the adhered surface 13 of the leaflet is abutted against the bottom surface 11 of the dispenser 1, such that there is no exposure of adhesive surface 16, described below. In this first non-adhering configuration, the dispenser may be moved freely without risk of inadvertent sticking against surfaces. The bottom surface 11 includes an adhesive area 16, which is sized and shaped to be about the same sized and shaped area as the anti-adhesive coated surface 13 of leaflet or it may have a smaller area than the anti-adhesive coated surface 13. The adhesive area 16 is placed on the bottom surface 11 in a position that aligns with the anti-adhesive coated surface 13 of the leaflet when in the closed, first non-adhering configuration. The adhesive on the adhesive area 16 should be sticky enough to secure the leaflet against the bottom surface 11 without being easily separated. Anti-adhesive coated surface 13 of leaflet may be coated with a non-adhering material to allow for sticking against the adhesive area 16 and pulled away therefrom with relative ease by a user. For example, the anti-adhesive coated surface 13 of the leaflet may be coated with silicone polymer, Teflon, or other non-stick coating materials.

The size of the adhesive area 16 should be large enough to hold the dispenser s1 for at least 2 weeks in a vertical position or alignment, and concurrently ensure that the front label may be opened without undesired release from the surface. While the overall size and area of the adhesive area 16 is important in allowing for secure and long lasting (e.g., greater than two weeks) adherence to a surface, the amount of and quality of adhesive used in the adhesive area 16 also plays a role in the proper adherence, while not being too adhering or large so as to stop a user from unsticking the package with a normal level of force enacted by a user.

The leaflet may be from about 95 mm in length and about 65 mm in width to about 170 mm in length and about 75 mm in width. The length and width of the leaflet should be large enough to fully cover the adhesive area 16.

It is desirable that the adhesive area 16 of the dispenser 1 be sticky enough to keep the dispenser 1 secured to a surface during use. In particular, the force required to separate the adhesive from a surface when use is complete should be higher than the force required to separate cover 7 from the top surface 5. In particular, since the closure 7 is located substantially in the center of the dispenser 1, the force required to separate closure 7 from top surface 5 should be lower than the force required to remove the adhesive area 16 from a surface when the dispenser 1 is pulled at a 90 degree angle from the surface to which it is secured. Suitable adhesives for the adhesive area 16 of leaflet include any known synthetic, semi-synthetic or natural adhesive, including, without limitation to acrylics, polyacrylate, silicones, hydrophilic gels, polyether, polyvinyl pyrrolidone, rubber resins, (e.g. nitrile rubber, styrene-acrylonitrile, styrene-isoprene-styrene, ethylene-vinyl acetate) and combination thereof.

The dispenser 1 may be converted to a second configuration (an adhering configuration) by pulling the tab 14 away from the bottom surface 11 and thereby separating the bottom surface 11 of the dispenser and the adhered surface 13 of the leaflet. Pulling the adhered surface 13 away from the bottom surface 11 of the dispenser reveals and exposes the adhesive area 16 on the bottom surface 11 of the dispenser 1. Further, since the leaflet is secured to the dispenser 1 at leaflet connection area 15, the leaflet may be pulled away from the surface 11 but still remain secured to the dispenser 1 for future use. In some embodiments, the second, adhering configuration is achieved by pulling the tab 14 away from the bottom surface 11 of the dispenser 1 sufficiently such that the tab is moved 180 degrees with respect to the leaflet connection area 15. As can be seen in FIG. 3, the tab 14 is being pulled in an arc like motion, where the leaflet connection area 15 is the center of the arc around which the tab 14 moves. This at least partially, and desirably fully exposes the adhesive area 16. The leaflet is desirably made of a flexible material, allowing it to be flexed and bent during use.

As noted above, the adhesive used in the adhesive area 16 is sticky enough to provide sticking to not only the adhered surface 13 of the leaflet but also to provide sticking to various surfaces when the adhesive area 16 is exposed. Surfaces to which the adhesive area 16 may be stuck include, for example, plastic, wood, and metal surfaces, including those that are painted or coated with various materials. In some embodiments, the surface to which the adhesive area 16 is stuck is a changing table, and in other embodiments, the surface is a dresser or other piece of furniture, while in other embodiments, the surface is a wall or cabinet. The adhesive used in adhesive area 16 should be strong enough to allow sticking to the surface and holding the dispenser 1 stuck thereto, but also resilient enough to allow the dispenser 1 to be removed therefrom without destroying either the dispenser 1 or the surface to which the dispenser has been stuck. In some aspects, the dispenser 1 may be stuck in a horizontal position, and in others, it may be stuck in a vertical position. Further, the dispenser may be stuck with the bottom surface 11 facing down (e.g., towards the ground or floor), or in others it may be stuck with the bottom surface 11 facing up (e.g., away from the ground or floor).

FIG. 3 shows a bottom perspective view of an exemplary package, where the leaflet free edge 18 is being pulled away from the adhesive area 16. The Figure shows the leaflet connection area 15 running substantially parallel to the length of the dispenser 1, however, the leaflet connection area 15 may be disposed in any desired region or configuration of the dispenser 1. The preferred embodiment includes leaflet connection area 15 running substantially parallel to the length of the bottom surface 11, and the leaflet connection area 15 being secured at a position closer to one edge of bottom surface 11 than an opposing edge. In this configuration, the leaflet may be separated from adhesive area 16 in such a fashion that the leaflet free edge 18 may be wrapped around the dispenser 1 surface, extending to at least a part of front surface 9 (or, alternatively, back surface 10).

Figure 4:
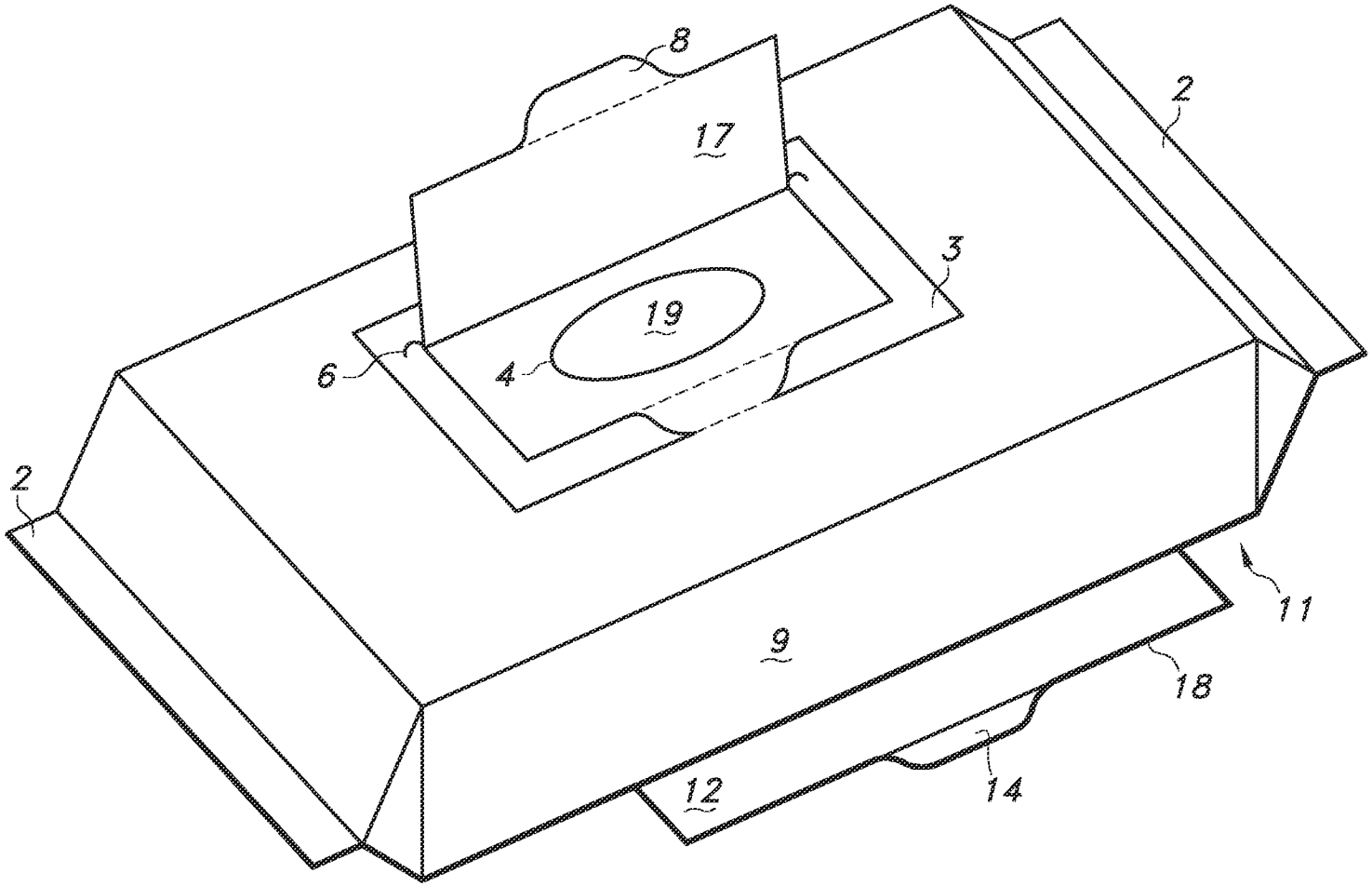
FIG. 4 is a top perspective view of the package of FIG. 1 with leaflet opened and top closure opened.

FIG. 4 shows a top perspective view of the dispenser 1 where the leaflet has been substantially separated away from the adhesive area 16. As can be seen, the leaflet has been pulled away such that the leaflet free edge 18 (and associated tab 14) can be seen when viewed from the top-down view. In this aspect, the adhesive area 16 is significantly exposed, if not fully exposed. In this adhesive exposed (the adhering) configuration, the bottom surface 11 of the dispenser 1 may be stuck against a surface, as described above. When adhered in such a manner, the leaflet does not get in the way of use, since it is abutted against the dispenser 1, specifically between the bottom surface 11 and the surface to which the dispenser 1 is stuck. A portion of the leaflet (specifically the leaflet free edge 18, e.g., including the tab 14) may stick out, but the leaflet is sized such that it will not be so large as to distract the user or prevent access to the access to wipes contained therein.

FIG. 4 also shows the dispenser 1 in a dispensing configuration, where access to the wipes contained therein are accessible. In this dispensing configuration, the bottom surface 17 of the closure 7 is exposed. The closure bottom surface 17 may include a releasable adhesive material, allowing it to be stuck and secured to the top surface 5 of the dispenser 1, closing aperture 4 when not in use. Suitable adhesives for the closure between closure bottom surface 17 and dispenser 1 include any known synthetic, semi-synthetic or natural adhesive. In some embodiments the adhesive for the closure between closure bottom surface 17 and dispenser 1 may be the same adhesive used to form the adhesive area 16, including, but not limited to acrylic copolymers and other adhesives identified above. In the non-dispensing configuration (where closure bottom surface 17 is secured to the top surface 5 of dispenser 1), there is a substantially water-tight or air-tight seal closing the aperture 4 in such a way that any wipes contained therein do not dry out.

In the dispensing configuration, it can be seen that the tab 8 on the closure 7 has been pulled away from the dispenser 1, exposing aperture 4 thereunder. Aperture 4 may have a fully open profile, allowing access therein, or it may have a further closure mechanism that requires the user to separate to access the interior of the dispenser 1. With access to the aperture 4, a user may reach fingers or tools into the dispenser 1, accessing at least one wipe 19 housed therein. Desirably, there is at least one wipe 19 contained within the dispenser, and more desirably there are a plurality of wipes 19 contained therein. The wipes 19 are preferably contained in such a manner that the user may withdraw only one wipe 19 out through the aperture 4 at a time. After use, the closure 7 may be pressed such that its bottom surface 17 is secured against the top surface 5 of the dispenser 1, closing the aperture 4 and keeping the contents of the dispenser 1 secured and in a substantially water-tight or air-tight non-dispensing configuration.

Thus, as described above, the dispenser 1 is convertible from various configurations, including the aforementioned non-adhering configuration, adhering configuration, dispensing configuration, and non-dispensing configuration. The dispenser 1 may be in combinations thereof, and in some embodiments it may be in a dispensing and non-adhering configuration, or it may be in a non-dispensing and non-adhering configuration, or it may be in a dispensing and adhering configuration, or it may be in a non-dispensing and adhering configuration. Various combinations of configurations are desired for different uses. For example, when the dispenser 1 is to be carried or moved, it may be desired to be in a non-dispensing and non-adhering configuration. When the dispenser is adhered to a surface and during use, the dispenser may be in an adhering and dispensing configuration.

The invention includes a method of dispensing products through a dispenser 1 explained above. Before use, the dispenser 1 may be in a non-adhering configuration and in a non-dispensing configuration. The non-adhering configuration includes leaflet secured against the adhesive area 16, and the non-dispensing configuration includes closure 7 bottom surface 17 secured against the top surface 5 of the dispenser 1, closing the aperture 4 and keeping the contents of the dispenser 1 secured and in a substantially water-tight or air-tight configuration. In this non-adhering, non-dispensing configuration, the dispenser 1 may be freely moved and carried by a user. Further, this is the configuration that the dispenser 1 may be in when displayed for sale or sold by a distributor.

When a user is ready to dispense a wipe, the user has several options. In one aspect, the user may not need to adhere the dispenser 1 to a surface, and may simply change the dispenser to a dispensing configuration. The dispensing configuration, as described above, is where the closure 7 has been pulled away from the top surface 5 of the dispenser 1, exposing aperture 4 and allowing access to the contents therein. A user may withdraw one or more products (e.g., wipes 19), and close the closure 7 when finished.

A more preferred method, however, includes an initial step of securing the dispenser 1 to a substantially flat surface, such as a wall, furniture, table, dresser, changing table, and the like. The substantially flat surface may be horizontal, vertical, or any configuration therebetween. Although the surface is described herein as a "substantially flat" surface, it is understood that the surface may include notches, ridges, raised/lowered areas, or may not be fully flat. The adhesive area 16 is desirably large enough to secure the dispenser 1 to a surface even with uneven, non-flat regions. The first step in this method is to expose the adhesive area 16. As described above, the adhesive area 16 may be exposed by pulling the tab 14 at the leaflet free edge 18 away from the bottom surface 10 of the dispenser 1. The tab 14 may be pulled in an arc-type motion, with the leaflet connection area 15 serving as the center of the arc. By pulling tab 14, the leaflet is pulled away from the adhesive area 16, thereby exposing at least a portion of, and desirably all of, the adhesive area 16. The bottom side 11 of the dispenser 1 may be pressed against the substantially flat surface, such that at least a portion of the adhesive surface 16 is stuck to the substantially flat surface, adhering the dispenser 1 thereto. It is noted that this configuration is the adhering configuration.

With the dispenser 1 secured to the substantially flat surface, a user may convert the dispenser 1 to a dispensing configuration, as described above, by pulling the tab 8 of the closure 7 and exposing aperture 4. It is desirable that the adhesive used to secure closure 7 to the top surface 5 is less adhering than the adhesive used in the adhesive are 16. Put another way, it is desired that the closure 7 be more easily separated from the top surface 5 than the adhesive area 16 be separated from the substantially flat surface. Thus, the user may open the closure 7 without substantially risking separating the dispenser 1 from the surface to which it is adhered. In the dispensing configuration, the user may withdraw one or more wipes 19 from the dispenser 1, and close the closure 7 when completed.

The user may leave the dispenser secured to the substantially flat surface for future use, if desired. Thus, the dispenser 1 may remain where it is secured, and when additional wipes 19 are desired, the user may simply open the closure 7, withdraw one or more wipes 19, and close the closure. This may be performed until the dispenser 1 is free of wipes 19, or until the user desires to remove the dispenser 1.

Alternatively, the user may separate the dispenser 1 from the substantially flat surface after a use. The dispenser 1 may be removed by pulling the adhesive area 16 away from the substantially flat surface until the dispenser 1 is removed from the substantially flat surface. To avoid undesirable and unintended sticking to other surfaces or objects, the user may convert the dispenser 1 to the non-adhering configuration, by pulling the tab 14 (and leaflet free edge 18) back to its original location on the bottom surface 10 of the dispenser 1, and pressing the leaflet non-adhered surface 12 against the adhesive area 16. It is desired that the entire adhesive area 16 be covered by the leaflet non-adhered surface 12, thereby fully covering the adhesive area 16.

In this non-adhering, non-dispensing configuration, the dispenser 1 may be carried or moved to any location desired. When additional wipes 19 are desired, the user may repeat the process outlined above.

The dispenser 1 may further include one or more indicia identifying the contents therein, as well as any other information desired. The dispenser 1 may also include instructions for use of the device, including graphics or text explaining how to convert the dispenser from the non-adhering configuration to the adhering configuration, and/or from the non-dispensing configuration to the dispensing configuration.

The present invention may include other dispensing packages beyond wipes dispensers, wherein there is an adhesive area covered by a leaflet. Different packages may be used as described above, where the force required to dispense a product therewithin is less than the force required to unstick the adhesive area from the surface to which it is adhered. Non-limiting examples include powder dispensers, lotion dispensers, jars, bottles, tins, cartons, and tubes, which dispense solid and liquid components, including, for example, shampoos, creams, powders, lotions, washes, and makeup remover. For example, the product may dispense a lotion, which is dispensed by removing a cap and squeezing the bottle. The force required to open and dispense the product should be less than the force required to unstick the product from the surface to which it is adhered.

EXAMPLES

Example 1

Method for Evaluation of Force Required

The present inventors have established a method for determining the force required to open or unstick a dispenser of the present invention (e.g., including a leaflet as described above). Unsticking is described as the force required (in Newtons) to remove the adhesive area of the package from a surface after it has been stuck thereto. For the Examples below, the inventors used a few pieces of measuring equipment. Equipment include: a Chatillon Pull Force Gauge Model 30D, scale 0-30 lbs with 0.25 lb divisions or equivalent; an EAME Gauge 0-500 Newton, with 0.15 N accuracy; and an Instron Model 1122 using MTS software. Equivalent devices may be substituted for these where needed or appropriate.

Tests are conducted after three time periods. The first is for the beginning of use of a package, when the package has not yet been used or has only been used a few times, that is, after the leaflet has been opened and stuck onto a surface only a few times. The beginning of use of the package includes sticking the adhesive area on the bottom of the package to a surface and removing it from 0-4 times. The second is the mid-use of a package, after the package has been used 4 times (that is, sticking the adhesive area on the bottom of the package to a surface and removing it), up to 8 times. Finally, the end use of a package is after the mid-use of a package, that is, after the adhesive area on the bottom of the package has been stuck to a surface and removed 8 times. The time periods of 0-4, 5-8, and 8+ are exemplary only and are not intended to mean that a package is only useful for a certain number of sticking/unsticking engagements.

The test for determining the unsticking force for a package includes first determining the force required to separate the leaflet from the package, thereby exposing the adhesive area. The package is supported on the device, and a portion of the leaflet is secured and pulled away from the bottom surface of the package. The force required to separate the leaflet from the adhesive area on the bottom surface is referred to as the "Back Label Opening Force". With this leaflet separated from the adhesive area, the bottom surface of the package is secured to a flat glass surface, such that the entire exposed adhesive area is stuck to the flat glass surface. With the package stuck to the glass surface, the Front Label Opening Force is determined by grasping the tab on the closure (on the top surface of the package) and pulling the tab until the aperture is exposed. The force required to pull the top closure is the Front Label Opening Force.

With the package still stuck to the glass surface and the closure opened (exposing the aperture), four wipes are removed from the package to simulate use. Then, the force required to unstick the package is measured in two ways. The first measures the force required to unstick the package from the glass surface by pulling from the front surface of the package, while the second measures the force required to unstick the package by pulling from the side welded section of the package. For each test, the particular side (front of package or side welded section) is grasped, and the package is pulled upward away from the glass surface. The force required to remove the package from the glass surface is referred to as the Unsticking Force. From this point, the leaflet may be secured back to the adhesive area on the bottom of the package, and the closure may be secured to the top surface of the package.

In the Examples, the steps above are repeated a plurality of times, giving force estimates after simulated usage. For example, the steps above may be repeated four times, giving force measurements during the "beginning" use of the package. The steps may then be repeated four more times, giving the measurements for a "mid-use" of the package, and the steps may be repeated four more times, giving the measurements for an "end use" of the package.

Example 2

Force Tests for Beginning Use of Package

Two packages were prepared, one having a smaller leaflet and one having a larger leaflet, where the terms "smaller" and "larger" are with respect to each other. A smaller leaflet size and adhesive area would be expected to provide a lower removal or unsticking force, while the larger leaflet and adhesive area would be expected to provide a higher removal or unsticking force. To provide a range of forces and sizes, two Packages were prepared.

The first package (the Smaller Leaflet) was prepared, the packaging made from a laminate including polyethylene terephthalate and polyethylene and having the configuration described above (top surface with aperture, bottom surface, front and back surfaces, and welded sides). The package was sized to house 56 wipes. The bottom surface of the package included an acrylic adhesive with an adhesive area of 95 mm×65 mm. A leaflet made from the same material as the package was secured to the bottom surface of the package, where 60 mm of the anti-adhesive surface of the leaflet was coated with a non-stick material including silicone. The leaflet connection area measured 5 mm×95 mm, where the leaflet was not coated with the non-stick material, thereby keeping the leaflet attached to the bottom surface of the package during use.

The second package (the Larger Leaflet) was also prepared, which was made from the same materials and had the same sizes as the Smaller Leaflet, with the exception that the adhesive area on the bottom surface of the second package had a size of 170 mm×75 mm. The leaflet was sized to cover this adhesive area, and included a non-stick coating on a portion of the anti-adhesive surface of the leaflet. The leaflet connection area was made in the same way as the first package, e.g., by including a portion of the leaflet that was not coated with the non-stick material and adhering that section to the adhesive area of the package.

Each of the first and second packages included an aperture on the top surface measuring 37 mm×19 mm, with a cover as described above. The same acrylic adhesive used for the bottom surface adhesive area was used to secure the cover to the top surface, covering the aperture when the package is in the closed configuration.

Four samples of each of a first package and a second package were tested to determine the various forces using the Method set forth in Example 1. For the Beginning Use of Package, the method of Example 1 was repeated four times for each package (thereby simulating uses 1 through 4). The various forces for each of the first package and the second package were measured, with their average values set forth in Table 1 below:

TABLE 1

Smaller Package and Larger Package Forces for Beginning Use of Package

| | Smaller Leaflet Forces (N) | Larger Leaflet Forces (N) |
|---|---|---|
| Top Cover Opening Force | 16.75* | 22.22* |
| Leaflet Opening Force | 4.62 | 13.96 |
| Unsticking Force (from front of package) | 32.14 | 55.185 |
| Unsticking Force (from side wall of package) | 14.19 | 24.19 |

*the first opening of the front label required additional force, due to the initial seal of the front label prior to first use.

The smaller leaflet (the first package) exhibited smaller forces during use. This Example shows exemplary force ranges for smaller adhesive areas and larger adhesive areas during the first four repeated uses of a package.

Example 3

Force Tests for Mid-Use of Package

The same packages tested in Example 2 were used to determine the forces of a Mid-Use package. The Mid-Use tests included repeating the method of Example 1 four times on the same package, thereby simulating uses 5 through 8. The various forces for each of the first package and the second package were measured and set forth in Table 2 below:

TABLE 2

Smaller Package and Larger Package Forces for Mid-Uses of Package

| | Smaller Leaflet Forces (N) | Larger Leaflet Forces (N) |
|---|---|---|
| Top Cover Opening Force | 5.4 | 5.5 |
| Leaflet Opening Force | 2.32 | 5.56 |
| Unsticking Force (from front of package) | 15.96 | 27.935 |
| Unsticking Force (from side wall of package) | 9.385 | 18.23 |

The smaller leaflet (the first package) again exhibited smaller forces during use, with the exception of the forces measured for the front label opening force, which was substantially similar. This would be expected, since the front label of both packages had the same size and configuration. This Example shows exemplary force ranges for smaller adhesive areas and larger adhesive areas during the first four repeated uses of a package.

Example 4

Force Tests for End Use of Package

The same packages tested in Example 3 were used to determine the forces of a End of Use package. The End Use tests included repeating the method of Example 1 four times on the same package, thereby simulating uses 5 through 8. The various forces for each of the first package and the second package were measured and set forth in Table 3 below:

TABLE 3

| Smaller Package and Larger Package Forces for End Use of Package | | |
|---|---|---|
| | Smaller Leaflet Forces (N) | Larger Leaflet Forces (N) |
| Top Cover Opening Force | 4.7 | 5.02 |
| Leaflet Opening Force | 2.6 | 3.72 |
| Unsticking Force (from front of package) | 14.455 | 24.365 |
| Unsticking Force (from side wall of package) | 7.165 | 17.160 |

The smaller leaflet (the first package) again exhibited smaller forces during use, with the exception of the forces measured for the front label opening force, which was substantially similar. This would be expected, since the front label of both packages had the same size and configuration. This Example shows exemplary force ranges for smaller adhesive areas and larger adhesive areas during the first four repeated uses of a package.

Averages and Conclusion from Examples 1-4

The average values for the smaller size leaflet package and the larger size leaflet package for all 12 simulated uses of each package (i.e., repeating the Method of Example 1 12 times), are set forth in Table 5 below:

TABLE 4

| Average Upper and Lower Limit Forces for Package | | |
|---|---|---|
| | Average for Smaller Leaflet Forces (N) | Average for Larger Leaflet Forces (N) |
| Top Cover Opening Force | 8.95 | 10.913 |
| Leaflet Opening Force | 3.18 | 7.747 |
| Unsticking Force (from front of package) | 20.852 | 35.828 |
| Unsticking Force (from side wall of package) | 10.247 | 19.860 |

The present inventors have made a number of discoveries through the testing and use of the packages of Examples 1-4. As expected, it was noticed that the unsticking force of the package reduced as the product was used (from beginning use to mid-use to end use). It was discovered that, regardless of the size of the leaflet and the adhesive area, the force to unstick the pack from the glass support when pulling the package from either the side or front was higher than the force to open the front label. The surprising result was that the difference in force in removing from pulling the front of the package compared to the top cover opening force was at least 10 Newtons for both sizes. This provides a product which has a lesser risk that the package would become unstuck from a support when opening the front label. This was true through not only the beginning use of the package (uses 1-4), but also the mid-use and the end-uses of the package. This demonstrates that the package would be acceptable through a plurality of uses and would still be useful after 12 repeated uses.

It was also discovered that opening the back label required a comparable level of force required as opening the front label, which is important in providing a commercial product that would allow a user to easily and simply remove the desired portion (e.g., the leaflet or the front cover) and use the product appropriately. Users are capable of peeling back the front cover or the leaflet as needed with ease and simplicity.

Finally, it was noted that the force required to remove the package from the surface when pulled from one of the sides (e.g., side walls 2) was never higher than 30 Newtons. This means that the packages may be removed from the surface by a user through application of a higher level of force required than to open the cover, but not such excessive force that the normal user cannot remove the package and re-use it at a later time and location. However, even with a smaller sized adhesive area (the first package with smaller leaflet), the force required to unstick the package from the glass support was never lower than 7 Newtons, which provides assurance that the package will not inadvertently be removed from the support without the application of force by a user. The very first opening of the top cover showed a greater force, but it is understood that this is due to the relative difficulty in first opening a cover, given a higher degree of tack and separating the pre-cutting associated with a product after coming off of a production line when the product is first distributed to a user. Put another way, the first opening of the top cover may act as a breaking of the initial seal at a pre-cut location, which is a higher required force for the first opening. After this first opening, the force to open the top cover is greatly reduced and is always lower than the unsticking force.

The inventors thus have discovered a new and useful way to transport a wipes package from location to location, while allowing a user the freedom and ability to use the package in a one-handed fashion after the package has been adhered to a surface. The leaflet on the package allows for repeated use and transport without the fear of inadvertent sticking during transport or during non-use. The forces required to open the leaflet, the closure, and to unstick the package from the surface reflect desired levels when a normal user is taken into account, with the average forces to unstick the package higher than the forces to remove the cover/front label.

What is claimed is:

1. A dispensing package comprising:

a. an interior region comprising at least one wipe, the interior region being defined by a top surface, a bottom surface, a front surface, a back surface, a first side and a second side;

b. the dispensing package including a single aperture, the single aperture located on the top surface for access to the interior region, the top surface being releasably sealed by a top cover; and c. the bottom surface having a coating of an adhesive area on at least a portion of the bottom surface, wherein the adhesive area is releasably covered by a leaflet, where the leaflet has an area at least as large as the adhesive area, and wherein the leaflet is secured to the bottom surface of the package at a leaflet securement area, wherein the leaflet securement area comprises the anti-adhesive surface of the leaflet being free of the anti-adhering coating at the leaflet securement area, wherein the leaflet securement area comprises an adhesive material that adheres the leaflet securement area to the adhesive area, wherein the leaflet securement area is strong enough to secure the leaflet to the dispenser repeatedly and withstand a force impacted when a user pulls the leaflet away from the bottom surface; wherein the adhering strength of the adhesive material in the leaflet securement area is stronger than that of the adhesive strength of the adhesive used to secure the anti-adhesive coated surface of the leaflet, wherein the leaflet may be separated from at least a portion of the adhesive area while the leaflet securement area is maintained with the leaflet secured to the adhesive area at the leaflet securement area, wherein the leaflet remains secured to the dispensing package such that the adhesive area can be re-covered with the leaflet, wherein re-covering the adhesive area prevents the dispensing package from being inadvertently secured to surfaces in between uses, and wherein uncovering the leaflet enables re-use of the adhesive area when desired, wherein a force required to separate the top cover from the aperture is lower than a force required to separate the leaflet from the adhesive area, and wherein a size of the adhesive area is large enough to hold the dispensing package for at least two weeks on a substantially flat surface to which it may be secured, while ensuring that the top cover can be opened without undesired release of the dispensing device from the substantially flat surface to which it may be secured.

2. The dispensing package of claim 1, wherein the package is made of a polymeric material.

3. The dispensing package of claim 1, wherein the top cover is releasably secured to the top surface via an adhesive.

4. The dispensing package of claim 1, wherein the aperture is sealed when the top cover is secured to the top surface.

5. The dispensing package of claim 1, wherein the leaflet is made from the same material as the bottom surface of the dispensing package.

6. The dispensing package of claim 1, wherein the force required to separate the top cover from the aperture is lower than the force required to unstick the adhesive area from a substantially flat surface to which it is secured.

7. The dispensing package of claim 1, wherein the adhesive area comprises an acrylic polymer material.

8. The dispensing package of claim 1, wherein the coating of adhesive area contains pressure sensitive adhesive.

9. The dispensing package of claim 2, wherein the pressure sensitive adhesives is selected from the group consisting of elastomeric block copolymers, natural rubber, butyl rubber and polyisobutylene, acrylic polymers, styrene-butadiene rubber (SBR), polyisoprene, polyalphaolefins, and polyacrylates, thermoplastic elastomeric block copolymers including styrene-isoprene (SI), styrene-isoprene-styrene (SIS), styrene-butadiene-styrene (SBS), ethylene-propylene-diene, styrene-ethylene/butylene-styrene (SEBS), and styrene-ethylene/propylene-styrene (SEPS), polyvinyl ethers, ethylene containing copolymers including ethylene vinyl acetate, ethylacrylate, and ethyl methacrylate, polyurethanes, polyamides, polyepoxides, polyvinylpyrrolidones and copolymers thereof, polyvinylalcohols and copolymers thereof, polyesters, and combinations thereof.

10. The dispensing package of claim 1, wherein the leaflet includes an anti-adhesive surface and an opposed non-adhered surface, with the anti-adhesive surface being in contact with the adhesive area when the leaflet covers the adhesive area.

11. The dispensing package of claim 10, wherein the anti-adhesive surface of the leaflet comprises an anti-adhering coating of silicone or teflon on the leaflet.

12. A method of using a dispensing package, comprising the steps of:

a. grasping a package with at least one hand, the package including:

i. an interior region comprising at least one wipe, the interior region being defined by a top surface, a bottom surface, a front surface, a back surface, a first side and a second side;

ii. the top surface including an aperture for access to the interior region, the top surface being releasably sealed by a top cover; and iii. the bottom surface having a coating of an adhesive area on at least a portion of the bottom surface, wherein the adhesive area is releasably covered by a leaflet, where the leaflet has an area at least as large as the adhesive area, and wherein the leaflet is secured to the bottom surface of the package at a leaflet securement area, wherein the leaflet securement area comprises the anti-adhesive surface of the leaflet being free of the anti-adhering coating at the leaflet securement area, and wherein the leaflet securement area comprises an adhesive material that adheres the leaflet securement area to the adhesive area, wherein the leaflet may be separated from at least a portion of the adhesive area while the leaflet securement area is maintained with the leaflet secured to the adhesive area at the leaflet securement area, wherein the leaflet remains secured to the dispensing package such that the adhesive area can be re-covered with the leaflet, wherein re-covering the adhesive area prevents the dispensing package from being inadvertently secured to surfaces in between uses, and wherein uncovering the leaflet enables re-use of the adhesive area when desired, wherein the leaflet securement area is strong enough to secure the leaflet to the dispenser repeatedly and withstand the force impacted when a user pulls the leaflet away from the bottom surface, wherein the adhering strength of an adhesive material in the leaflet securement area is stronger than that of the adhesive used to secure the anti-adhesive coated surface of the leaflet;

b. separating at least a portion of the leaflet from the adhesive area; and c. attaching the adhesive area to an adhered surface, the adhered surface being selected from one of: furniture, tile, wall, floor, or carpet, wherein a force required to separate the top cover from the aperture is lower than a force required to separate the leaflet from the adhesive area, wherein a size of the adhesive area is large enough to hold the dispensing package for at least two weeks on a substantially flat surface to which it may be secured, while ensuring that the top cover can be opened without undesired release of the dispensing device from the substantially flat surface to which it may be secured.

13. The method of claim 12, wherein the leaflet includes an anti-adhesive surface and an opposed non-adhered surface, with the anti-adhesive surface being in contact with the adhesive area when the leaflet covers the adhesive area.

14. The method of claim 12, wherein the adhesive area comprises an acrylic polymer.

15. The method of claim 12, wherein the anti-adhesive surface of the leaflet comprises an anti-adhering coating of silicone or teflon on the leaflet.

16. The method of claim 12, further comprising the step of:

d. separating at least a portion of the top cover from the top surface, thereby opening the aperture and allowing access to the interior region.

17. The method of claim 16, further comprising the step of:

e. removing a wipe from the interior region of the package.

18. The method of claim 17, further comprising the steps of:

f. securing the top cover to the top surface, thereby sealing the aperture;

g. unsticking the adhesive area from the adhered surface; and h. placing the leaflet on the adhesive area, thereby covering the adhesive area with the leaflet.

* * * * *